US009486714B1

(12) United States Patent
Carrel et al.

(10) Patent No.: US 9,486,714 B1
(45) Date of Patent: Nov. 8, 2016

(54) HURDLE WITH COUNTERWEIGHT

(71) Applicant: Litania Sports Group, Inc., Champaign, IL (US)

(72) Inventors: Bryan R. Carrel, Urbana, IL (US); Christopher E. Bray, Champaign, IL (US); C. David Hodge, Mahomet, IL (US)

(73) Assignee: Litania Sports Group, Inc., Champaign, IL (US)

( * ) Notice: Subject to any disclaimer, the term of this patent is extended or adjusted under 35 U.S.C. 154(b) by 0 days.

(21) Appl. No.: 14/816,154

(22) Filed: Aug. 3, 2015

(51) Int. Cl.
*A63B 21/00* (2006.01)
*A63K 3/04* (2006.01)

(52) U.S. Cl.
CPC ..... *A63K 3/043* (2013.01)

(58) Field of Classification Search
CPC ..... A63B 21/00
USPC ..... 482/15, 23, 14
See application file for complete search history.

(56) References Cited

U.S. PATENT DOCUMENTS

| | | | | |
|---|---|---|---|---|
| 3,366,381 | A * | 1/1968 | Ross | A63K 3/043 482/17 |
| 4,749,187 | A | 6/1988 | Dellinger et al. | |
| 7,438,668 | B1 | 10/2008 | Watry et al. | |
| 7,785,233 | B1 * | 8/2010 | Moore | A63K 3/043 482/15 |
| 8,636,623 | B2 * | 1/2014 | Ross | A63K 3/043 482/14 |
| 8,968,157 | B2 | 3/2015 | Lindstrom | |

* cited by examiner

*Primary Examiner* — Jerome W Donnelly
(74) *Attorney, Agent, or Firm* — Philip L. Bateman

(57) ABSTRACT

A hurdle with movable gate tubes that telescope upon uprights has an automatically movable counterweight inside each leg. Each counterweight is attached to two cables. The first cable runs from the leading end of the counterweight to a cable guide inside the leading end of each leg, then to a cable guide at the intersection of the leg and the upright, then to an actuating rod. The second cable runs from the trailing end of the counterweight to a cable guide at the intersection of the leg and the upright, then to a cable guide near the top of the upright, and then to the actuating rod.

10 Claims, 4 Drawing Sheets

HURDLE WITH COUNTERWEIGHT

FIELD OF THE INVENTION

This invention relates to exercise devices. More particularly, this invention relates to track and field equipment. Still more particularly, this invention relates to hurdles.

BACKGROUND OF THE INVENTION

Track and field is a sport in which athletes compete in running, jumping, and throwing events. The hurdles are two events that combine running and jumping. In the hurdles, the athletes run in designated lanes and jump over spaced apart hurdles in between the start and finish. A hurdle consists of a base having two legs, two uprights, and a horizontal gate board (sometimes spelled "gateboard"). In the first hurdle event (commonly known as the high hurdles), athletes run about 100 meters and jump over relatively high hurdles. In the second hurdle event (commonly known as the low or intermediate hurdles), athletes run about 400 meters and jump over lower hurdles. The height of the hurdle in each of the events varies depending upon the age and sex of the athletes. For versatility and economy, most hurdles are adjustable in height. Adjustable hurdles contain movable gate tubes (also known as risers) that telescope relative to uprights. The gate board is attached to the gate tubes.

A hurdle is designed to tip over if the athlete contacts it. The force at the gate board required to tip the hurdle over is commonly known as its pull over weight. The pull over weight is a function of the height of the hurdle. Other things being equal, the pull over weight decreases as the height of the hurdle increases. Most hurdles contain counterweights in the base to achieve the desired pull over weight. To maintain a relatively constant pull over weight as the height of the hurdle changes, many modern hurdles incorporate counterweights that move in the legs of the base. As the height of the hurdle increases, the counterweights are moved further away from the uprights and, as the height of the hurdle decreases, the counterweights are moved toward the uprights. In some hurdles, the counterweights are moved manually. In other hurdles, the counterweights are connected mechanically to the gate board so that they move automatically as the gate board is moved.

Hurdles with automatically movable counterweights connected to the gate board are disclosed in Dellinger et al., U.S. Pat. No. 4,749,187, Jun. 7, 1988, and Watry et al., U.S. Pat. No. 7,438,668, Oct. 21, 2008. Both the Dellinger et al. and the Watry et al. hurdles contain counterweights inside the legs of the base that are connected to the gate board by a mechanical system consisting of cables, pulleys, and coil springs. In the Dellinger et al. hurdle, the coil springs are located in the legs whereas in the Watry et al. hurdle, the coil springs are located in the uprights. There are two disadvantages associated with coil spring counterweight systems. First, the coil springs apply a downwardly directed force to the gate tubes and gate board. Raising the gate boards on these hurdles require the force of the coil springs to be overcome. Second, hurdles are subjected to rough treatment and the coil springs are the component that malfunctions or breaks most frequently. The coil springs are difficult to repair because of their location.

Lindstrom, U.S. Pat. No. 8,968,157, Mar. 3, 2015, discloses a hurdle with automatically movable counterweights connected to the gate board. The Lindstrom hurdle uses a system of gear wheels and racks in the legs of the base instead of a coil spring system. The gear wheels and racks in the Lindstrom hurdle are also prone to malfunction when the hurdle is subjected to rough treatment.

Accordingly, a demand exists for an improved hurdle. In particular, a demand exists for an improved and more durable hurdle that requires less force to raise the hurdle and that contains automatically movable counterweights without coil springs, gear wheels, and racks.

SUMMARY OF THE INVENTION

The general object of this invention is to provide an improved hurdle. A more particular object is to provide a hurdle that contains automatically movable counterweights without coil springs, gear wheels, and racks.

We have invented an improved hurdle. The hurdle comprises: (a) two substantially parallel horizontal hollow legs, each leg having a leading end and a trailing end; (b) two stationary hollow uprights, each upright extending upwardly from the trailing end of a leg, and defining an intersection between a leg and an upright; (c) two movable hollow gate tubes, each gate tube telescoping relative to an upright and having a top end; (d) a gate board connecting the top ends of the gate tubes; (e) a mechanism for adjusting the gate board to a plurality of heights; (f) a counterweight inside each leg, each counterweight being movable horizontally and having a leading end and a trailing end; (g) a first cable guide attached inside the leading end of each leg; (h) a second cable guide attached inside each intersection between a leg and an upright; (i) a third cable guide attached inside each upright; (j) a vertical actuating rod inside each gate tube, each actuating rod having a top and a bottom, each top being attached to the gate tube; (k) a first cable connected to the leading end of each counterweight, then running horizontally to and around the first cable guide, then running horizontally to and around the second cable guide, then running vertically to and connecting with the bottom of the actuating rod; and (l) a second cable connected to the trailing end of each counterweight, then running horizontally to and around the second cable guide, then running vertically to and around the third cable guide, and then running vertically to and connecting with the bottom of the actuating rod.

The hurdle of this invention has a continuous loop counterweight system that moves the counterweights automatically without coil springs, gear wheels, and racks. The hurdle of this invention is more durable and its gate board is more easily raised.

DETAILED DESCRIPTION OF THE INVENTION

1. The Invention in General

Figure 1:
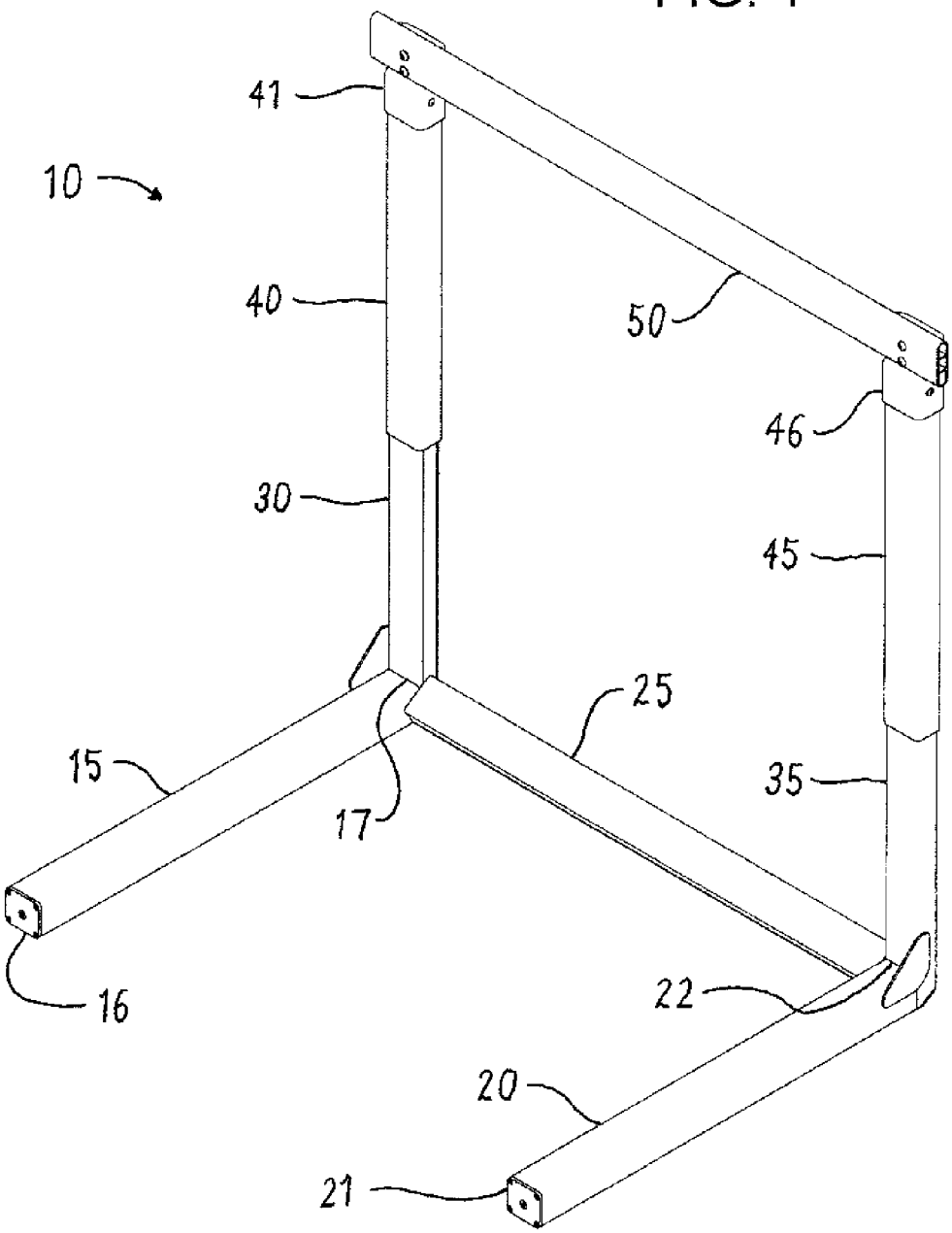
FIG. 1 is a front and right side perspective view of the exterior of a preferred embodiment of the hurdle of this invention.

This invention is best understood by reference to the drawings. A preferred embodiment of the hurdle 10 of this invention has two legs 15 and 20 and a cross support 25. Two stationary uprights 30 and 35 extend upwardly from the legs. The legs, cross support, and the upright are often collectively referred to as the base assembly. Two movable telescoping gate tubes 40 and 45 fit over the uprights. A gate board 50 connects the top ends of the gate tubes. The gate tubes and the gate board are often collectively referred to as the riser assembly. A height adjustment system 60 enables the position of the gate tubes and gate board relative to the uprights to be varied. An internal counterweight system 70 automatically moves a counterweight in each leg to maintain the pull over weight relatively constant as the height of the gate board is varied. The components are discussed in detail below.

2. Dimensions

The size of the hurdle is typically set by a track and field governing body. The hurdle generally has a width of either about forty-one inches or about forty-seven inches and the height of the hurdle (measured from the ground to the top of the gate board) is generally adjustable between about thirty and forty-two inches. The height of the hurdle is fixed by the position of the riser assembly relative to the base assembly. The hurdle preferably contains a plurality of set height adjustments. In the preferred embodiment, each upright has five adjustments for the following categories: (1) women's low; (2) women's high; (3) men's intermediate; (4) high school boy's high; and (5) men's high.

3. Legs

The hurdle contains two horizontal legs 15 and 20 having a length that is typically set by a track and field governing body. The legs are hollow to accommodate the counterweight system. The legs are substantially parallel so they do not intrude upon the lane in which the hurdle is located or upon the adjacent lanes. Each leg has a leading end 16 and 21 and a trailing end 17 and 22. The terms "leading" and "trailing" refer to the direction from which the athlete approaches the hurdle. The legs are preferably joined by a cross support 25 to provide more structural strength. In the preferred embodiment, the cross support connects the trailing ends of the legs. Alternatively, the cross support can be positioned between the lower ends of the uprights. The legs and cross support are preferably made of rectangular aluminum tubing with a width of about two to three inches.

4. Uprights

Stationary hollow uprights 30 and 35 extend upwardly from the trailing ends of the legs. In the preferred embodiment, the uprights are made of rectangular aluminum tubing with a width of about two to three inches. In the preferred embodiment, molded plastic caps 31 and 36 fit into the tops of the uprights. As explained below, the plastic caps contain guides and attachment points for components of the height adjustment system and the counterweight system. As previously mentioned, the uprights, legs, and cross support are commonly known collectively as the base assembly.

The uprights may contain a plurality of vertically spaced apart bores that, in combination with the height adjustment mechanism on each side, are used to set the height of the hurdle. The uprights preferably contain five bores for the five standard hurdle heights. As explained below, the bores in the uprights of the preferred embodiment are located in an internal wall to eliminate the entry of dirt and water into the interior of the hurdle.

5. Gate Tubes

Telescoping gate tubes 40 and 45 fit over, within, or beside the uprights. In the preferred embodiment, the gate tubes are rectangular aluminum tubes that fit over the uprights. The inside dimensions of the telescoping tubes are preferably slightly greater than the outside dimensions of the uprights so the telescoping gate tubes can move freely up and down. In the preferred embodiment, molded plastic caps 41 and 46 fit onto the tops of the gate tubes. The plastic caps contain recesses for the attachment of the gate board and for connection of components of the height adjustment and counterweight systems.

6. Gate Board

A gate board 50 connects the tops of the gate tubes. In the preferred embodiment, the gate board is attached to the caps on the gate tubes. The gate board has a height of about two to four inches and is generally made of a durable lightweight material such as LEXAN polycarbonate, polyvinyl chloride (PVC), wood, or the like. As previously mentioned, the assembly of the gate board and the telescoping gate tubes is commonly known as the riser assembly. To adjust the height of the hurdle, the riser assembly is moved relative to the base assembly (the legs, cross support, and the uprights).

7. Height Adjustment System

The height adjustment system 60 is used to adjust the height of the gate board. The height is determined by the position of the riser assembly relative to the base assembly. The particular mechanism of the height adjustment system is a matter of choice. In hurdles containing a plurality of bores in each upright, the height adjustment mechanism typically includes a vertical member with a distal post (sometimes referred to as a pin) that extends through a selected bore in the upright and a proximate handle (sometimes referred to as a trigger or button) extending out of each gate tube. The vertical member is typically biased by a spring in one direction to force the post into the bore. Squeezing, depressing, or otherwise moving the handle moves the member and disengages the post from the bore.

A variety of height adjustment mechanisms are used in hurdles and all are suitable for use with the hurdle of this invention. Many height adjustment mechanisms work with uprights having the spaced apart vertical bores in their outer surfaces. For example, a mechanism with a manipulator and latch is disclosed in Dellinger et al., U.S. Pat. No. 4,749,187, Jun. 7, 1988; a mechanism with triggers and contiguous trigger tubes is disclosed in Watry et al., U.S. Pat. No. 7,438,668, Oct. 21, 2008; and a mechanism with a locking pin and a tension spring is disclosed in Lindstrom, U.S. Pat. No. 8,968,157, Mar. 3, 2015.

Figure 2:
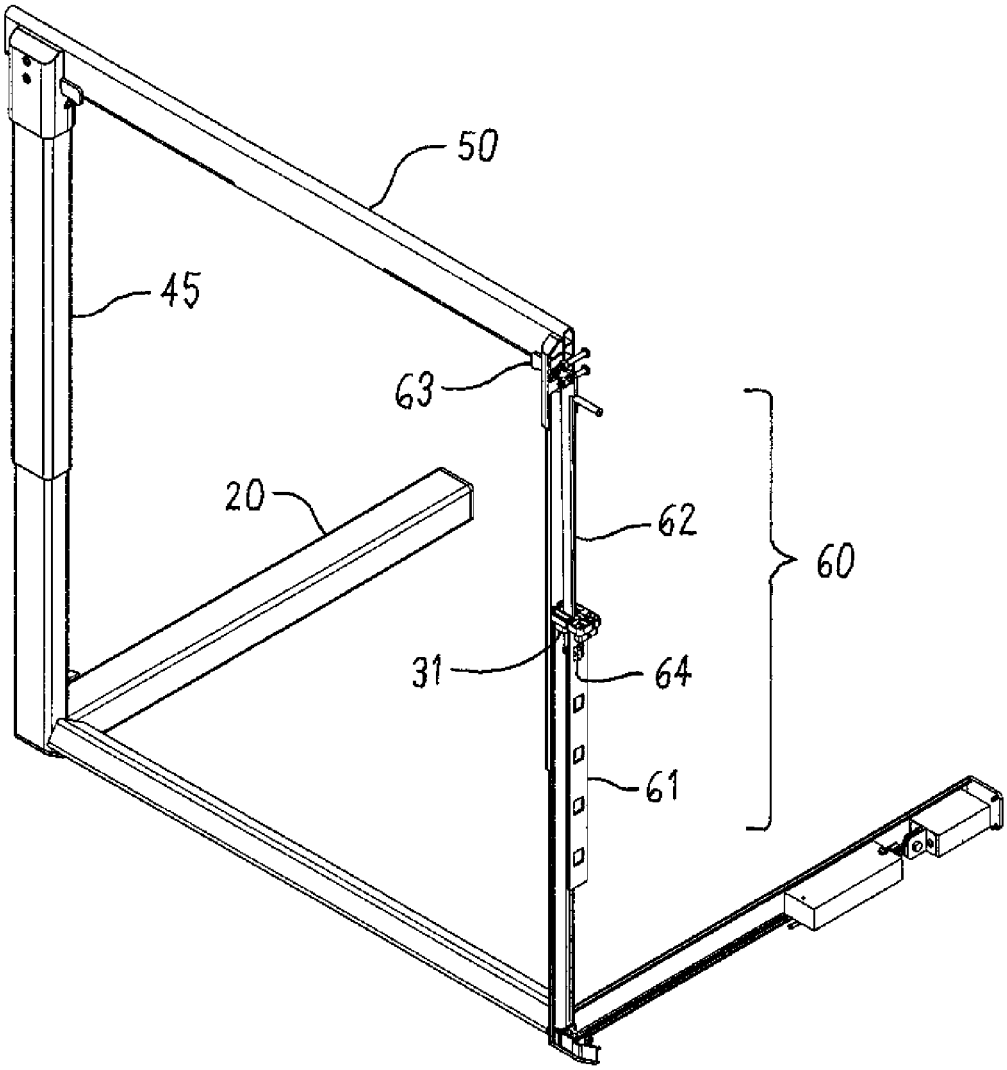
FIG. 2 is a rear and left side cutaway perspective view thereof with the left side interior height adjustment system shown.

FIG. 2 shows the preferred embodiment of the hurdle with the left leg, upright, and gate tube omitted (cut away) to show the interior. The preferred embodiment has no bores in the outer surface of the uprights. Instead, its height adjustment system includes an internal wall 61 inside each upright with five spaced apart bores. The height adjustment mechanism on each side includes a vertical actuating rod 62 with a proximate handle 63 at its top and a distal horizontally projecting post 64 at its bottom. The top of the rod fits into a recess in the cap on top of the gate tube. A torsion spring engages the top of the rod and biases the post in an outward direction. When the handles are squeezed, the posts move inwardly and the gate tubes are free to telescope. When the handles are released, the posts move outwardly into one of the bores. Locating the height adjustment bores in an internal wall eliminates the problems caused by the entry of dirt and water through external bores into the interior of the hurdle.

8. Counterweights

Figure 3:
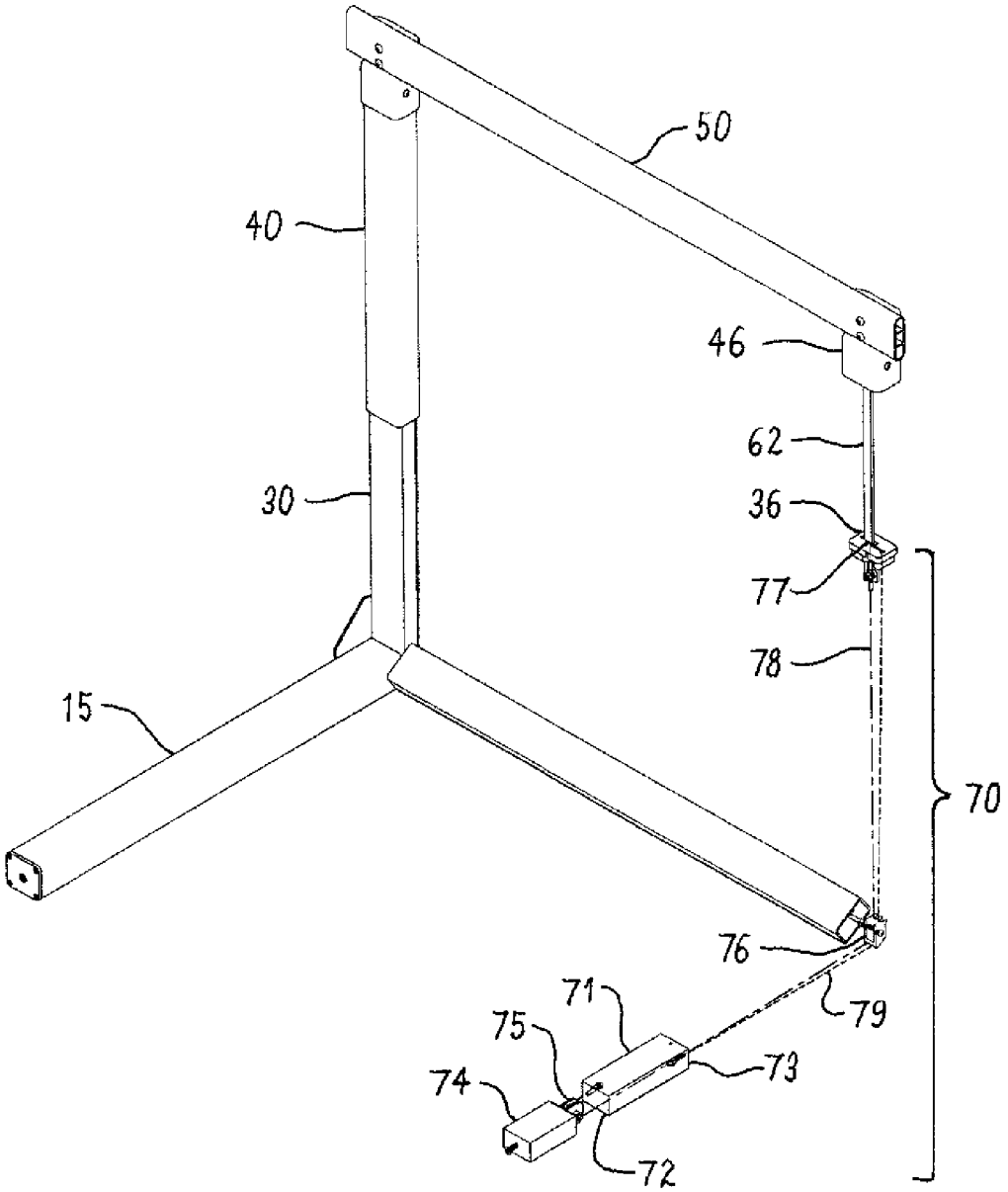
FIG. 3 is a front and right side cutaway perspective view thereof with the right side interior counterweight system shown.

FIG. 3 shows the preferred embodiment of the hurdle with the right leg, upright, and gate tube omitted (cut away) to show the interior. The hurdle contains an internal counterweight system 70 that automatically moves a counterweight in each leg to maintain the pull over weight relatively constant regardless of the height and within limits set by the relevant track and field governing body. The system is substantially the same on each side of the hurdle so only the right side is shown and described. The counterweight system includes a counterweight, cable guides, an actuating rod, and cables.

The counterweight 71 has a leading end 72 and a trailing end 73. The shape of the counterweight generally conforms to the shape of the leg. In the preferred embodiment, the leg and the counterweight both have rectangular cross-sections. The size of the counterweight is preferably slightly less than the internal size of the leg. In other words, the counterweight is small enough so that it does not bind and large enough that it cannot turn or rotate or otherwise change orientation.

The weight of the counterweight is a matter of choice that depends on the weight and dimensions of the hurdle. The counterweight is preferably made of a dense material such as steel or the like. The counterweight moves back and forth inside the leg so friction between the bottom of the counterweight and interior of the leg is preferably minimized. Smooth surfaces on both the counterweight and the leg interior generally are sufficient. In the preferred embodiment, the leg interior contains reinforcing ribs upon which the counterweight rides, thereby reducing the area of contact and reducing friction. If even less friction is desired, plastic rails, rollers, or the like are added to the counterweight or the leg interior. The counterweight is positioned midway along the leg when the hurdle is at a middle height so that the counterweight can move in both directions (toward the leading end when the height of the hurdle increases and toward the trailing end when the height of the hurdle decreases).

In addition to a movable counterweight, a permanently mounted counterweight 74 in the leading end of each leg is often desirable to achieve the desired pull over weight.

9. Cable Guides

The internal counterweight system contains three cable guides on each side. The first guide 75 is positioned inside the leading end of the leg. The second guide 76 is positioned at the intersection of the leg and the upright. The third guide 77 is positioned at or near the top the upright. The term "near" the top is used herein to mean within about five inches of the top. The height of the third guide determines the distance the counterweight can travel. For maximum counterweight travel, the third guide is located at the top of the upright. In the preferred embodiment, the third guide is part of the cap 36 that fits into the top of the upright.

The guides are conventional. Non-moving cable guides such as plastic blocks with cable channels or grooves are preferred for their durability. Pulleys are preferred for their decreased friction. Bars, posts, and the like are also suitable as guides. If desired, the counterweight system has cable guides of different types. For example, the preferred embodiment has a pulley at the leading end of the leg attached to the permanently mounted counterweight and plastic blocks at the other two locations.

10. Actuating Rod

The internal counterweight system contains a vertical actuating rod 62 inside the gate tube and upright on each side. The top of the actuating rod is connected directly or indirectly to the gate tube and the bottom of the actuating rod extends into the upright. In the preferred embodiment, the top of the actuating rod is connected to the plastic cap on the gate tube. As explained in detail below, the actuating rod provides an attachment point for the cables that is below the third guide. The actuating rod thus provides the mechanism for applying a pulling force to one of the cables when the gate board is raised and to the other cable when the gate board is lowered. It can be seen that the actuating rod performs two functions in the preferred embodiment. It forms the connecting point for the cables of the counterweight system and it forms the actuator of the height adjustment mechanism as described above.

11. Cables

Figure 4:
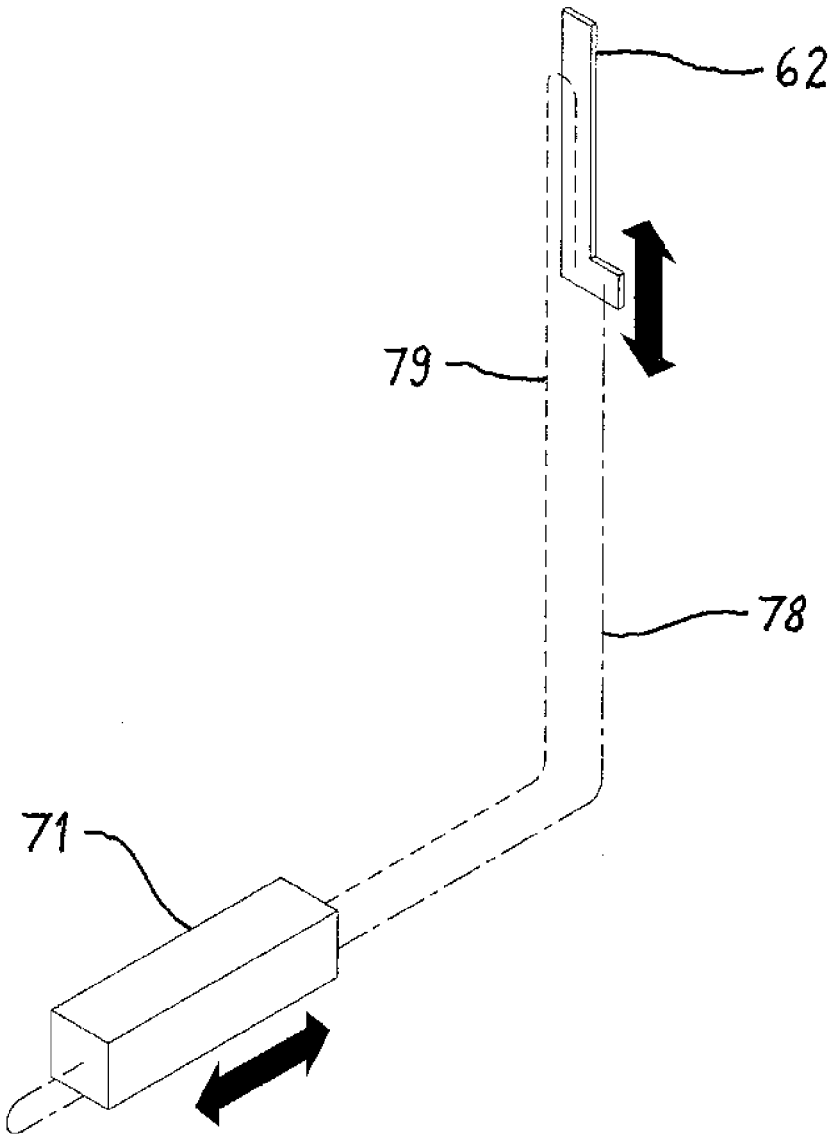
FIG. 4 is a diagram showing the cables of the counterweight system.

The internal counterweight system contains a first cable 78 and a second cable 79 on each side. The cables are shown in FIG. 3 and their routings are shown in diagrammatic detail in FIG. 4. For illustration purposes in FIGS. 3 and 4, the first cable is shown in alternating long and short broken lines and the second cable is shown in short broken lines. The counterweights and actuating rod are shown in FIG. 4, but the cable guides are omitted for clarity.

One end of the first cable 78 is connected to the leading end of the counterweight. The first cable then runs horizontally to and around the first cable guide at the leading end of the leg. The first cable then runs horizontally in the opposite direction to and around the second cable guide at the intersection of the leg and the upright. The cable then runs vertically up to the actuating rod. The cable is preferably attached to the bottom of the actuating rod. The connections of the first cable to the counterweight and actuating rod are matters of choice. For example, fittings such as hooks, screws, or the like are suitable.

One end of the second cable 79 is connected to the trailing end of the counterweight. The second cable then runs horizontally to and around the second cable guide at the intersection of the leg and the upright. The second cable then runs vertically up to and around the third cable guide at the top of the upright. The second cable then runs vertically in the opposite direction down to the bottom of the actuating rod. The second cable is attached to the bottom of the actuating rod. The connections of the second cable to the counterweight and actuating rod are identical or similar to the connections to the first cable.

The cables are sufficiently taut that they are retained on the cable guides and drag little against the interior of the legs and uprights. If desired, one or more of the cable guides includes a mechanism for adjusting cable tension. A variety of tensioning mechanisms are known in the art. In the preferred embodiment, the first cable guide at the leading end of the legs is attached to a screw whose head is accessible from the exterior of the hurdle. Turning the adjustment screw clockwise causes the cable guide to move toward the leading end and increases cable tension. The reverse is achieved by turning the adjustment screw counterclockwise. The cable is preferably made of steel.

12. Operation And Advantages

The operation of the hurdle can now be considered. The height adjustment mechanism is released and the gate board is moved to the desired position before use. The movement of the gate board causes each actuating rod to move and one of the two cables to be pulled on each side. The pulling of one cable causes the other cable to move as well. As the cables move, the counterweight automatically moves back or forth within the leg to keep the pull over weight relatively constant and within limits set by the relevant track and field governing body.

The counterweight system requires no maintenance and its elimination of coil springs provides two important and distinct advantages to the hurdle. First, the force needed to raise the hurdle is greatly reduced because there is no spring force that must be overcome. Second, the hurdle is exceptionally durable because there is no spring to break or become dislodged.

We claim:

1. A hurdle comprising:

(a) two substantially parallel horizontal hollow legs, each leg having a leading end and a trailing end;

(b) two stationary hollow uprights, each upright extending upwardly from the trailing end of a leg, and defining an intersection between a leg and an upright;

(c) two movable hollow gate tubes, each gate tube telescoping relative to an upright and having a top end;

(d) a gate board connecting the top ends of the gate tubes;

(e) a mechanism for adjusting the gate board to a plurality of heights;

(f) a counterweight inside each leg, each counterweight being movable horizontally and having a leading end and a trailing end;

(g) a first cable guide attached inside the leading end of each leg;

(h) a second cable guide attached inside each intersection between a leg and an upright;

(i) a third cable guide attached inside each upright;

(j) a vertical actuating rod inside each gate tube, each actuating rod having a top and a bottom, each top being attached to the gate tube;

(k) a first cable connected to the leading end of each counterweight, then running horizontally to and around each first cable guide, then running horizontally to and around each second cable guide, then running vertically to and connecting with the actuating rod; and (l) a second cable connected to the trailing end of each counterweight, then running horizontally to and around each second cable guide, then running vertically to and around each third cable guide, and then running vertically to and connecting with the actuating rod.

2. The hurdle of claim 1 additionally comprising a horizontal cross support connecting the trailing ends of the legs.

3. The hurdle of claim 1 wherein at least one of the cable guides is adjustable in position to vary the tension on the cables.

4. The hurdle of claim 1 wherein the third cable guide is attached at or near the top of each upright.

5. The hurdle of claim 1 wherein each upright contains a plurality of vertically spaced apart bores and wherein the mechanism for adjusting the gate board to a plurality of heights comprises a spring loaded member with a distal post that extends through a selected bore in each upright and a handle in each gate tube for disengaging the spring loaded member.

6. An adjustable height hurdle with a relatively constant pull over weight, the hurdle comprising:

(a) two horizontal hollow legs, each leg having a leading end and a trailing end;

(b) two vertical hollow uprights, each upright extending upwardly from the trailing end of a leg, and defining an intersection between a leg and an upright;

(c) two vertical hollow gate tubes, each gate tube telescoping relative to an upright and having a top end;

(d) a horizontal gate board connecting the top ends of the gate tubes;

(e) a counterweight inside each leg, each counterweight being movable horizontally and having a leading end and a trailing end;

(f) a first cable guide attached inside the leading end of each leg;

(g) a second cable guide attached inside each intersection between a leg and an upright;

(h) a third cable guide attached inside each upright;

(i) a vertical actuating rod inside each gate tube, each actuating rod having a top and a bottom, each top being attached to the gate tube;

(j) a first cable connected to the leading end of each counterweight, then running horizontally to and around each first cable guide, then running horizontally to and around each second cable guide, then running vertically to and connecting with the actuating rod; and (k) a second cable connected to the trailing end of each counterweight, then running horizontally to and around each second cable guide, then running vertically to and around each third cable guide, and then running vertically to and connecting with the actuating rod.

7. The hurdle of claim 6 additionally comprising a horizontal cross support connecting the trailing ends of the legs.

8. The hurdle of claim 6 wherein at least one of the cable guides is adjustable in position to vary the tension on the cables.

9. The hurdle of claim 6 wherein the third cable guide is attached at or near the top of each upright.

10. The hurdle of claim 6 wherein each upright contains a plurality of vertically spaced apart bores and additionally comprising a mechanism for adjusting the gate board to a plurality of heights that comprises a spring loaded member with a distal post that extends through a selected bore in each upright and a handle in each gate tube for disengaging the spring loaded member.

* * * * *